US008007420B2

(12) United States Patent
Mullin

(10) Patent No.: US 8,007,420 B2
(45) Date of Patent: Aug. 30, 2011

(54) PORTABLE EXERCISE DEVICE AND SYSTEM INCLUDING SAME

(76) Inventor: Peter Mullin, Jeannette, PA (US)

( * ) Notice: Subject to any disclaimer, the term of this patent is extended or adjusted under 35 U.S.C. 154(b) by 0 days.

(21) Appl. No.: 12/690,531

(22) Filed: Jan. 20, 2010

(65) Prior Publication Data

US 2010/0184569 A1 Jul. 22, 2010

Related U.S. Application Data

(60) Provisional application No. 61/205,203, filed on Jan. 20, 2009.

(51) Int. Cl.
*A63B 21/00* (2006.01)

(52) U.S. Cl. ..... 482/127; 482/124

(58) Field of Classification Search ..... 482/127, 482/124

See application file for complete search history.

(56) References Cited

U.S. PATENT DOCUMENTS

| | | | |
|---|---|---|---|
| 4,358,126 | A | 11/1982 | Mitchell et al. |
| 4,869,494 | A | 9/1989 | Lambert, Sr. |
| 5,242,179 | A | 9/1993 | Beddome et al. |
| 5,303,945 | A | 4/1994 | Oxford |
| 5,509,673 | A | 4/1996 | Wu et al. |
| 6,203,474 | B1 | 3/2001 | Jones |
| 6,371,502 | B1 | 4/2002 | Howlett et al. |
| 6,792,908 | B1 | 9/2004 | Shimizu |
| 2003/0153441 | A1 * | 8/2003 | Berns et al. ..... 482/128 |

OTHER PUBLICATIONS

"The Resistance Chair Exercise & Rehabilitation System", 2008, available at www.vqactioncare.com/prod-cfrc100.php on Jan. 20, 2010.

* cited by examiner

*Primary Examiner* — Jerome W Donnelly
(74) *Attorney, Agent, or Firm* — Reed Smith LLP

(57) ABSTRACT

A portable exercise device. The portable exercise device includes a recoil assembly, a clutch assembly, an adjustable resistance assembly, a housing assembly, and a flexible cable member. The clutch assembly is coupled to the recoil assembly. The adjustable resistance assembly is coupled to the clutch assembly. The housing assembly includes a first portion and a second portion. The first portion defines and opening therethrough and surrounds the recoil assembly and the clutch assembly. The second portion is rotatably coupled to the first portion, defines a configured projection, and surrounds the adjustable resistance assembly. The flexible cable member is coupled to the recoil assembly, and extends through the opening defined by the first portion of the housing assembly.

20 Claims, 20 Drawing Sheets

PORTABLE EXERCISE DEVICE AND SYSTEM INCLUDING SAME

CROSS-REFERENCE TO RELATED APPLICATION

This application claims the benefit under 35 U.S.C. §119 (e) of the earlier filing date of U.S. Provisional Patent Application No. 61/205,203 filed on Jan. 20, 2009.

BACKGROUND

This application discloses an invention which is related, generally and in various embodiments, to a portable exercise device and a system which includes the portable exercise device.

The benefits of exercising are well documented. However, for a variety of reasons, a significant number of people are temporarily or permanently unable to access and/or utilize currently available exercise equipment. For example, people who are confined to a bed or to a wheel chair are generally unable to unable to access and/or utilize currently available exercise equipment.

Although some specialized exercise equipment is available to people in those and other similar situations, the specialized exercise equipment tends to be expensive, relatively bulky, located at facilities other than the homes of the people, and not easily moved from one location to another. Thus, such specialized exercise equipment is not generally suitable for in home use, and many people who would gain benefits from using such equipment on a regular basis fail to do so.

SUMMARY

In one general respect, this application discloses a portable exercise device. According to various embodiments, the portable exercise device includes a recoil assembly, a clutch assembly, an adjustable resistance assembly, a housing assembly, and a flexible cable member. The clutch assembly is coupled to the recoil assembly. The adjustable resistance assembly is coupled to the clutch assembly. The housing assembly includes a first portion and a second portion. The first portion defines and opening therethrough and surrounds the recoil assembly and the clutch assembly. The second portion is rotatably coupled to the first portion, defines a configured projection, and surrounds the adjustable resistance assembly. The flexible cable member is coupled to the recoil assembly, and extends through the opening defined by the first portion of the housing assembly.

In another general respect, this application discloses a system. According to various embodiments, the system includes a portable exercise device and a clamp assembly removably connected to the portable exercise device. The portable exercise device includes a recoil assembly, a clutch assembly, an adjustable resistance assembly, a housing assembly, and a flexible cable member. The clutch assembly is coupled to the recoil assembly. The adjustable resistance assembly is coupled to the clutch assembly. The housing assembly includes a first portion and a second portion. The first portion defines and opening therethrough and surrounds the recoil assembly and the clutch assembly. The second portion is rotatably coupled to the first portion, defines a configured projection, and surrounds the adjustable resistance assembly. The flexible cable member is coupled to the recoil assembly, and extends through the opening defined by the first portion of the housing assembly. The clamp assembly is removably connected to the portable exercise device, and defines a recess configured to receive the configured projection of the second portion of the housing assembly of the portable exercise device.

BRIEF DESCRIPTION OF THE DRAWINGS

Various embodiments of the invention are described herein in by way of example in conjunction with the following figures, wherein like reference characters designate the same or similar elements.

FIGS. 12A and 1213 illustrate various embodiments of the sleeve 102 of the portable exercise device 10 of FIG. 1;

DETAILED DESCRIPTION

It is to be understood that at least some of the figures and descriptions of the invention have been simplified to illustrate elements that are relevant for a clear understanding of the invention, while eliminating, for purposes of clarity, other elements that those of ordinary skill in the art will appreciate may also comprise a portion of the invention. However, because such elements are well known in the art, and because they do not facilitate a better understanding of the invention, a description of such elements is not provided herein.

Figure 1:
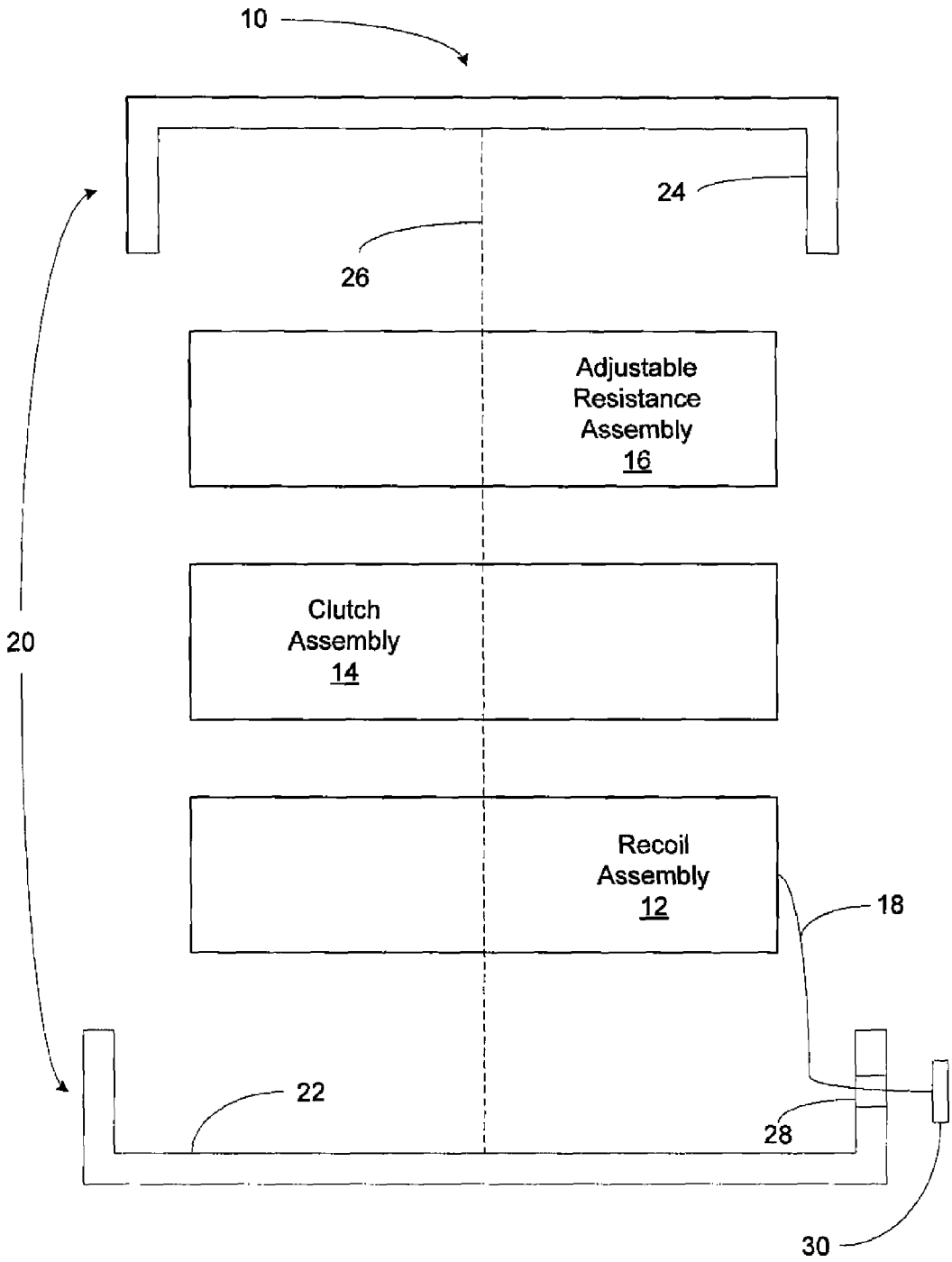
FIG. 1 illustrates a high-level representation of a portable exercise device according to various embodiments.

FIG. 1 illustrates a high-level representation of a portable exercise device 10 according to various embodiments. For purposes of clarity, the high-level representation is shown in an exploded view. The portable exercise device 10 includes a recoil assembly 12, a clutch assembly 14 coupled to the recoil assembly 12, an adjustable resistance assembly 16 coupled to the clutch assembly 14, a flexible cable member 18 coupled to the recoil assembly 12, and a housing assembly 20 which includes a first portion 22 and a second portion 24.

The housing assembly 20 defines a central axis 26. The first portion 22 of the housing assembly 20 defines an opening 28 therethrough, and surrounds the recoil assembly 12 and the clutch assembly 14. As shown in FIG. 1, the flexible cable member 18 also extends through the opening 28 and, according to various embodiments, is coupled to a handle 30 which is positioned external to the housing assembly 20. The second portion 24 of the housing assembly 20 is rotatably coupled to the first portion 22 of the housing assembly 20 (i.e., the first and second portions are rotatable relative to one another), surrounds the adjustable resistance assembly 16, and defines a configured projection. The configured projection defined by the second portion 24 of the housing assembly 20 will be described in more detail herebelow.

According to various embodiments, as described in more detail hereinbelow, the portable exercise device 10 further includes a sleeve which is connected to the second portion 24 of the housing assembly 20, and a retainer ring which is coupled to the sleeve and threadedly connected to the first portion 22 of the housing assembly 20. The sleeve surrounds the second portion 24 of the housing assembly 20, is open ended, and operates as a bushing which allows the first and second portions 22, 24 of the housing assembly 20 to rotate relative to one another. The retainer ring operates to prevent the first and second portions 22, 24 of the housing assembly 20 from moving apart from one another.

Additionally, as described in more detail hereinbelow, the first portion 22 of the housing assembly 20 defines a receptacle, and the portable exercise device 10 further includes a shaft member which is received by the receptable and extends from a surface of the first portion 22 of the housing assembly 20 to a surface of the second portion 24 of the housing assembly. For such embodiments, the shaft member is aligned with the central axis 26, and the recoil assembly 12, the clutch assembly 14, and the adjustable resistance assembly 16 each surround the shaft member.

Figure 2:
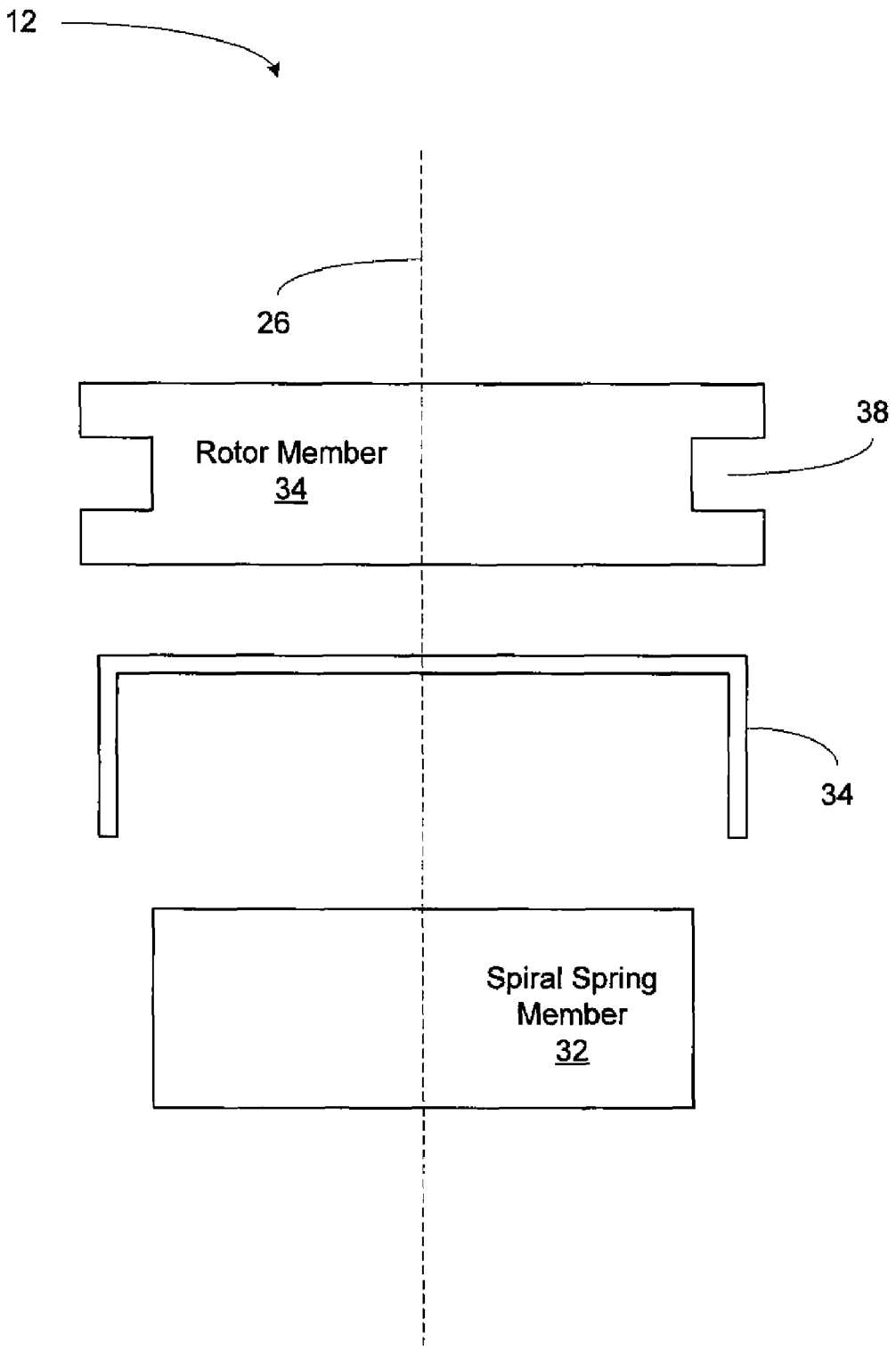
FIG. 2 illustrates a high-level representation of a recoil assembly of the portable exercise device of FIG. 1 according to various embodiments.

FIG. 2 illustrates a high-level representation of the recoil assembly 12 of the portable exercise device 10 of FIG. 1 according to various embodiments. For purposes of clarity, the high-level representation is shown in an exploded view. The recoil assembly 12 includes a spiral spring member 32, and a rotor member 34 coupled to the spiral spring member 32. As shown in FIG. 2, according to various embodiments, the recoil assembly 12 also includes a spiral spring cover member 36 positioned between the spiral spring member 32 and the rotor member 34. The spiral spring member 32, the rotor member 34, and the spiral spring cover member 36 are each surrounded by the first portion 22 of the housing assembly 20. For embodiments where the portable exercise device 10 includes the shaft member, the spiral spring member 32, the rotor member 34, and the spiral spring cover member 36 each surround the shaft member.

The rotor member 34 is rotatable about the central axis 26, and defines a channel 38 for receiving the flexible cable member 18 (the flexible cable member 18 is wound around the rotor member 34 in the channel 38). For purposes of simplicity, the flexible cable member 18 is not shown in FIG. 2. When one end of the flexible cable member 18, which has another end coupled to the rotor member 34, is pulled away from the housing assembly 20, the flexible cable member 18 unwinds from the channel 38, passes through the opening 28, and advances away from the housing assembly 20, and the rotor member 34 is rotated about the central axis 26 in a first direction. When the pulling force applied to the flexible cable member 18 ceases, the rotor member 34 rotates about the central axis 26 in the opposite direction, and the extended flexible cable member 18 is pulled back toward the housing assembly 20, passes back through the opening 28, and is wound back around the rotor member 34 in the channel 38.

The spiral spring member 32 includes a first end, a main body, and a second end. The first end may be considered the outer end and the second end may be considered the inner end. According to various embodiments, the first end of the spiral spring member 32 is positioned in a recess defined by the first portion 22 of the housing assembly 20 and is fixed in place. The main body and the second end of the spiral spring member 32 are positioned within another recess defined by the first portion 22 of the housing assembly 20, with the second end of the spiral spring member 32 being positioned proximate the central axis 26. When the rotor member 34 is coupled to the second end of the spiral spring member 32 and is rotated about the central axis 26 in a first direction, the second end of the spiral spring member 32 is wound around the central axis 26 in the first direction, thereby storing rotational energy which when released (e.g., when the pulling force applied to the flexible cable member 18 ceases), operates to rotate the second end of the spiral spring member 32 and the rotor member 34 in the opposite direction, thereby returning the spiral spring member 32 and the rotor member 34 to their respective restarting positions.

For embodiments which include the spiral spring cover member 36, the spiral spring cover member 36 surrounds the spiral spring member 32 and operates to keep the spiral spring member 32 positioned in a fixed plane perpendicular to the central axis 26.

Figure 3:
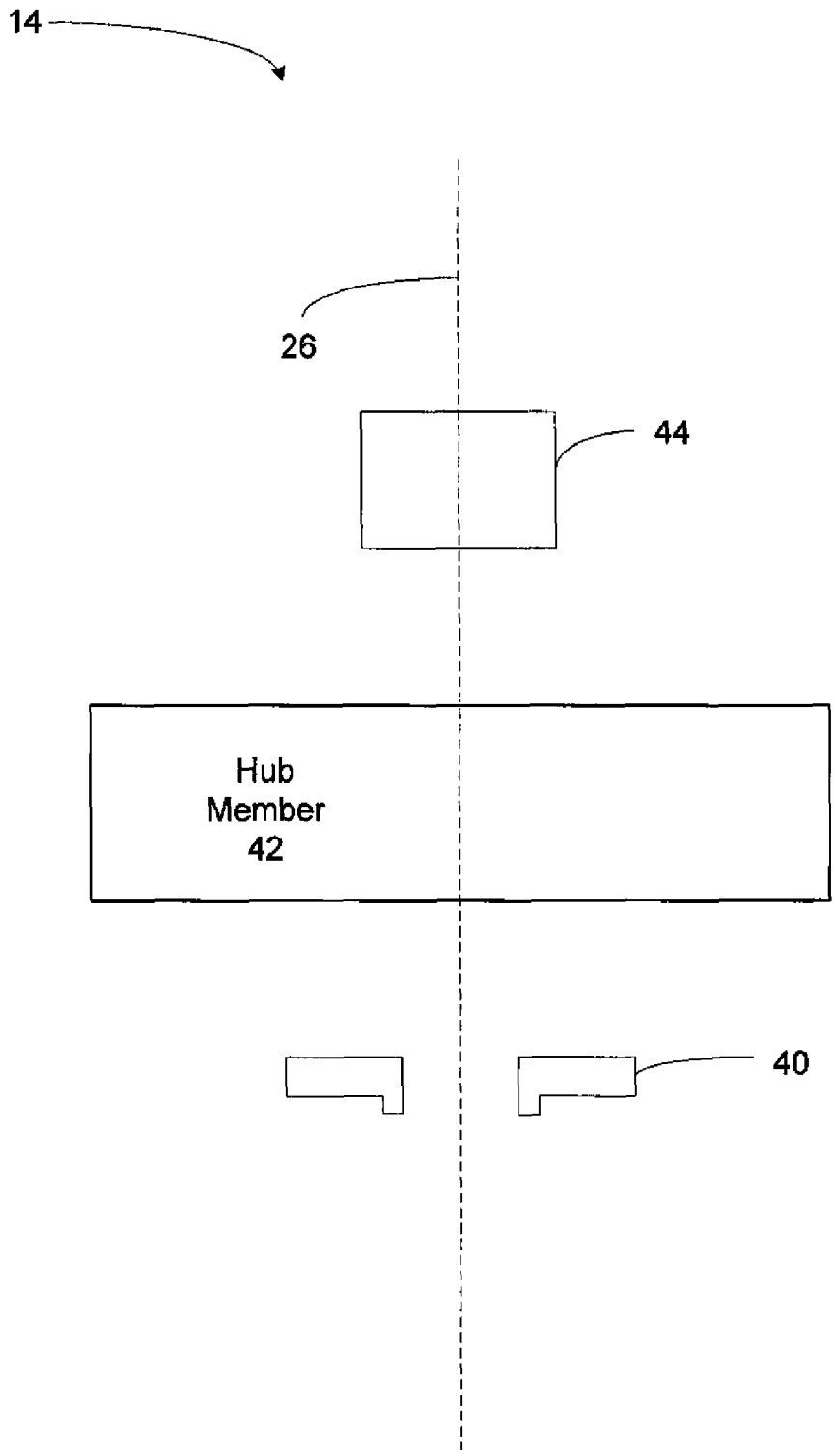
FIG. 3 illustrates a high-level representation of a clutch assembly of the portable exercise device of FIG. 1 according to various embodiments.

FIG. 3 illustrates a high-level representation of the clutch assembly 14 of the portable exercise device 10 of FIG. 1 according to various embodiments. For purposes of clarity, the high-level representation is shown in an exploded view. The clutch assembly 14 includes a plurality of dog pawls 40 pivotably coupled to the rotor member 34 of the recoil assembly 12, and a hub member 42 coupled to the plurality of dog pawls 40. As shown in FIG. 3, according to various embodiments, the clutch assembly 14 also includes a bushing 44 which is coupled to and surrounded by the hub member 42. The dog pawls 40 and the hub member 42 are each surrounded by the first portion 22 of the housing assembly 20. The hub member 42 is also surrounded by the second portion 24 of the housing assembly 20, and the bushing 44 is also surrounded by the second portion 24 of the housing assembly 20. For embodiments where the portable exercise device 10 includes the shaft member, the hub member 42 and the bushing 44 each surround the shaft member.

The hub member 42 and the bushing 44 are each rotatable about the central axis 26. The hub member 42 defines a plurality of directional teeth which are configured to engage with the dog pawls 40. When the rotor member 34 is rotated in a first direction, the dog pawls 40 coupled to the rotor member 34 are also rotated about the central axis 26 in the first direction. The rotation of the dog pawls 40 about the central axis 26 in the first direction causes the dog pawls 40 to pivot radially outward from the central axis 26, and as the dog pawls 40 pivot radially outward from the central axis 26, the dog pawls 40 are engaged by the directional teeth of the hub member 42, thereby causing the hub member 42 and the bushing 44 to also rotate about the central axis 26 in the first direction.

Figure 4:
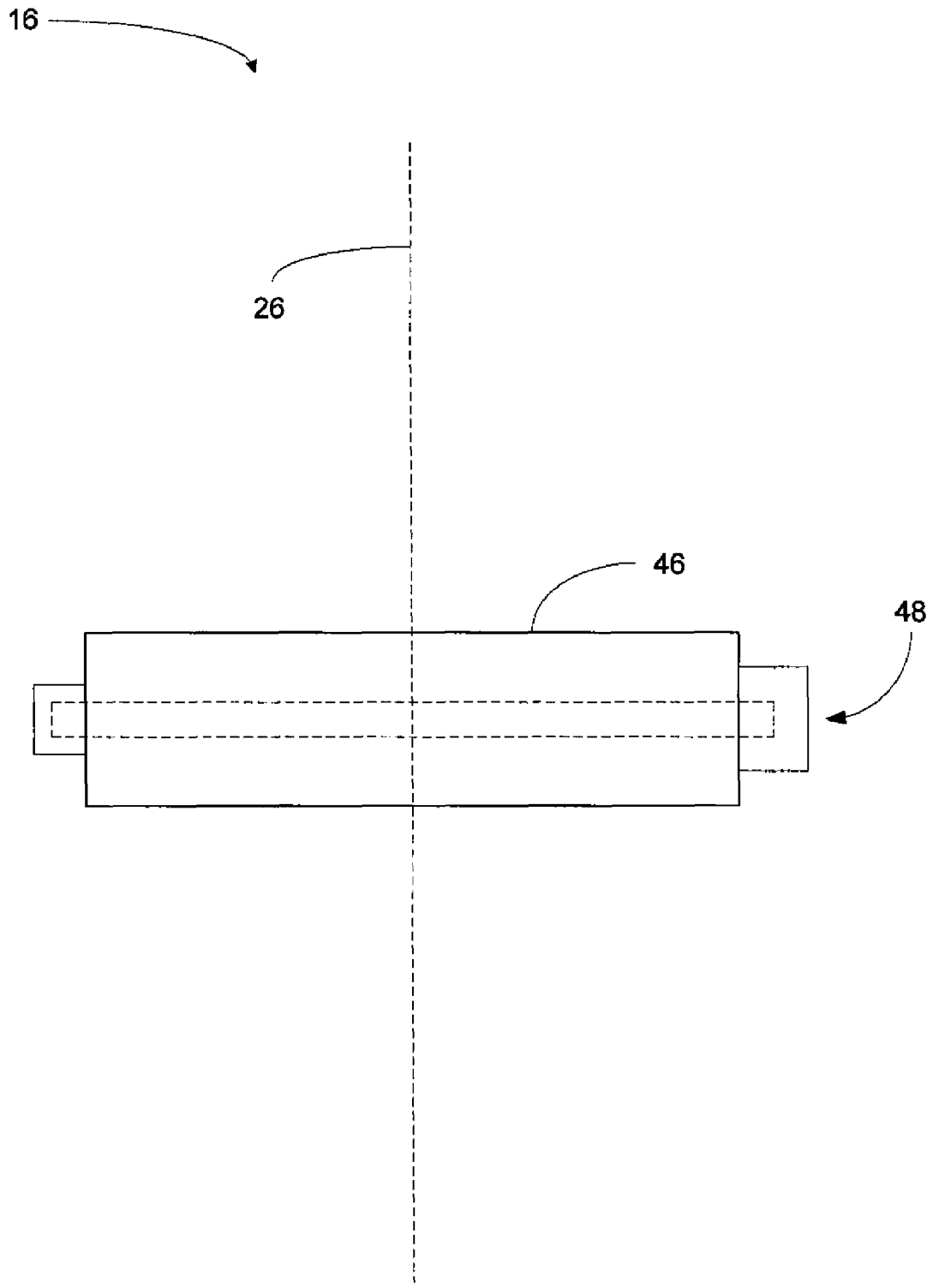
FIG. 4 illustrates a high-level representation of an adjustable resistance assembly of the portable exercise device of FIG. 1 according to various embodiments.

FIG. 4 illustrates a high-level representation of the adjustable resistance assembly 16 of the portable exercise device 10 of FIG. 1 according to various embodiments. The adjustable resistance assembly 16 includes a brake member 46, and an adjustment assembly 48 which passes through the brake member 46. The brake member 46 is positioned within a recess defined by the second portion 24 of the housing assembly 20, surrounds the clutch assembly 14, and is surrounded by the second portion 24 of the housing assembly 24. According to various embodiments, the brake member 46 is open ended, and the adjustment assembly 48 passes through first and second ends of the brake member 46.

The adjustment assembly 48 is utilized to control how tightly the brake member 46 is coupled to the hub member 42. The tighter the coupling between the brake member 46 and the hub member 42, the more difficult it is to cause the hub member 42, and thus the rotor member 34, to rotate about the central axis 26 in the first direction by pulling an end of the flexible cable member 18 away from the housing assembly 20. The less tight the coupling between the brake member 46 and the hub member 42, the less difficult it is to cause the hub member 42, and thus the rotor member 34, to rotate about the central axis 26 in the first direction by pulling an end of the flexible cable member 18 away from the housing assembly 20.

As described in more detail hereinafter, according to various embodiments, the adjustment assembly 48 includes a threaded member which passes through two openings defined by the second portion 24 of the housing assembly 20 and through two openings defined by the brake member 46. One of the two openings defined by the brake member 46 is defined by the first end of the brake member 46, and the other of the two openings define by the brake member 46 is defined by the second end of the brake member 46. For such embodiments, the adjustment assembly 48 also includes a knob connected to one end of the threaded member, and a fastener such as, for example, a nut connected to the other end of the threaded member. Both the knob and the fastener are external to the housing assembly 20. Additionally, according to various embodiments, as described in more detail hereinafter, the adjustable resistance assembly 16 further includes a plug member positioned within a third opening defined by the brake member 46, and the plug member is threadedly connected to the adjustment assembly 48. The third opening may be defined by either the first end or the second end of the brake member 46.

Figure 5B:
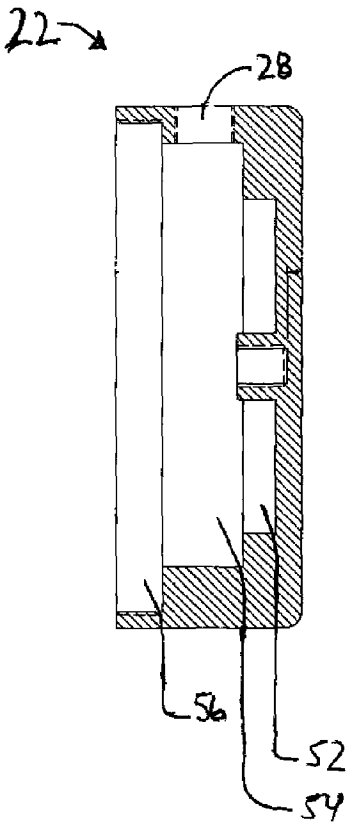
FIGS. 5A-5C illustrate various embodiments of a first portion of a housing assembly of the portable exercise device of FIG. 1
Figure 5A:
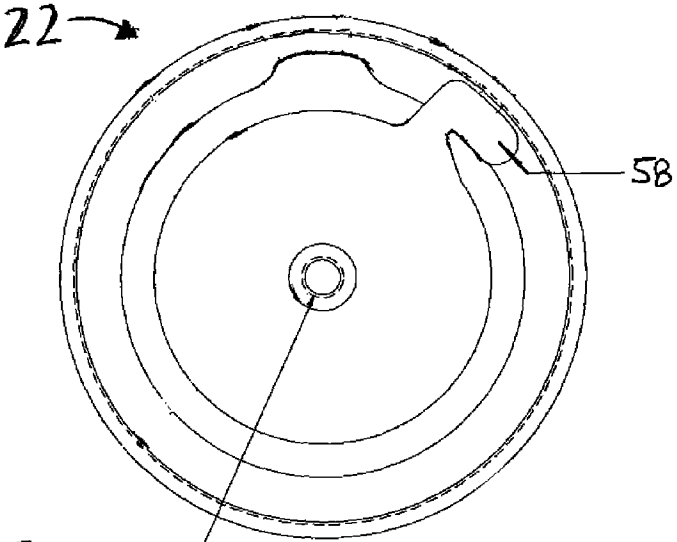
Figure 5C:
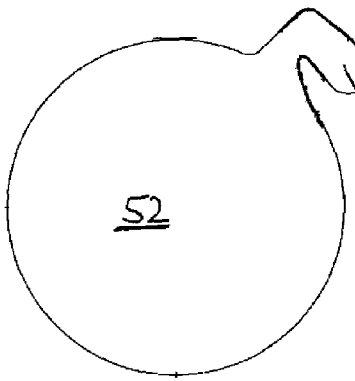

FIGS. 5A-5C illustrate various embodiments of the first portion 22 of the housing assembly 20 of the portable exercise device 10 of FIG. 1. The first portion 22 may be fabricated from any suitable material. For example, according to various embodiments, the first portion 22 is fabricated from an aluminum. According to other embodiments, the first portion 22 is fabricated from a plastic. As shown in the top view of FIG. 5A, the first portion 22 is substantially cylindrical in shape, and defines a receptacle 50 at the center thereof configured for receiving a shaft member. As shown in the side view of FIG. 5B, the first portion 22 also defines the opening 28, defines a first cylindrically shaped volume 52 configured for receiving the spiral spring member 32 and the spiral spring cover member 36, defines a second cylindrically shaped volume 54 configured for receiving the rotor member 34 and part of the hub member 42, and defines a third cylindrically shaped volume 56 configured for receiving a part of the second portion 24 of the housing assembly 20. As shown in FIG. 5A, the first portion 22 also defines a recess 58 which receives the first end of the spiral spring member 32. The top view of FIG. 5C shows that a surface of the recess 58 and a surface of the first cylindrically shaped volume 52 are coplanar.

Figure 6:
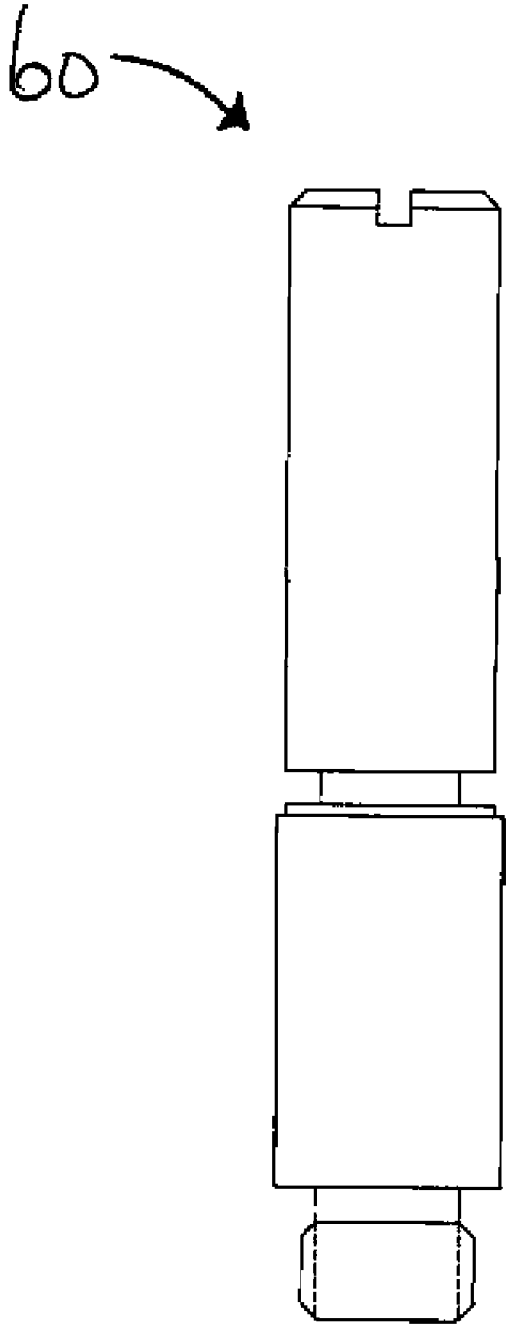
FIG. 6 illustrates various embodiments of a shaft member of the portable exercise device of FIG. 1.

FIG. 6 illustrates various embodiments of the shaft member 60 of the portable exercise device 10 of FIG. 1. The shaft member 60 may be fabricated from any suitable material. For example, according to various embodiments, the shaft ember 60 is fabricated from a stainless steel. The shaft member 60 is sized to be received by the receptacle 50, and to extend from a surface of the first portion 22 of the housing assembly 20 to a surface of the second portion 24 of the housing assembly 20.

Figure 7B:
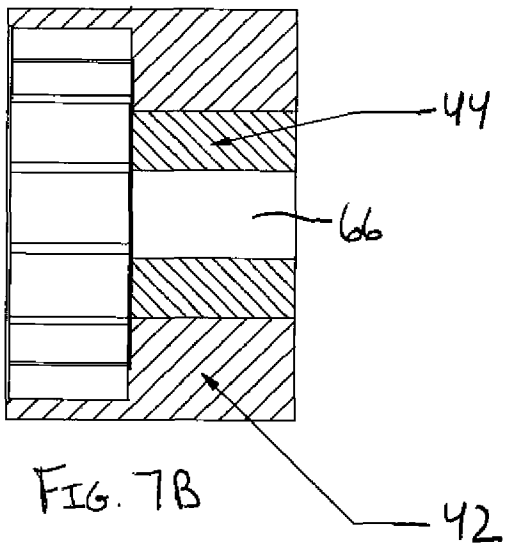
FIGS. 7A-7C illustrate various embodiments of a hub member and a bushing of the portable exercise device of FIG. 1
Figure 7A:
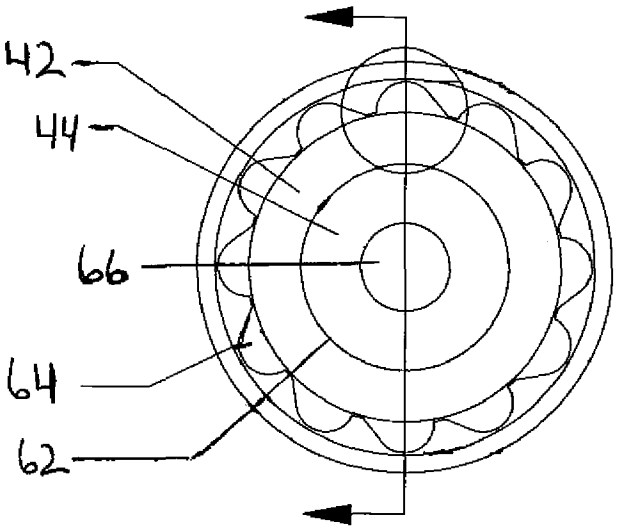
Figure 7C:
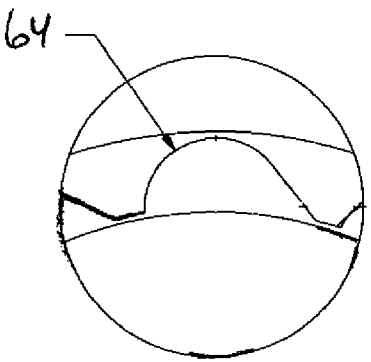

FIGS. 7A-7C illustrate various embodiments of the hub member 42 and the bushing 44 of the portable exercise device 10 of FIG. 1. The hub member 42 and the bushing 44 may be fabricated from any suitable materials. For example, according to various embodiments, the hub member 42 is fabricated from a stainless steel and the bushing is fabricated from a brass. As shown in bottom view of FIG. 7A, the hub member 42 and the bushing 44 are each substantially cylindrical in shape. The hub member 42 defines an opening 62 therethough, and defines a plurality of directional teeth 64. FIG. 7B is a cross-section of FIG. 7A, and FIG. 7C is a detail of one of the directional teeth 64. The opening 62 is configured to receive the bushing 44, and thus is hidden from view in FIGS. 7A and 7B. The bushing 44 defines an opening 66 which is configured to receive the shaft member 60 therethrough.

Figure 8B:
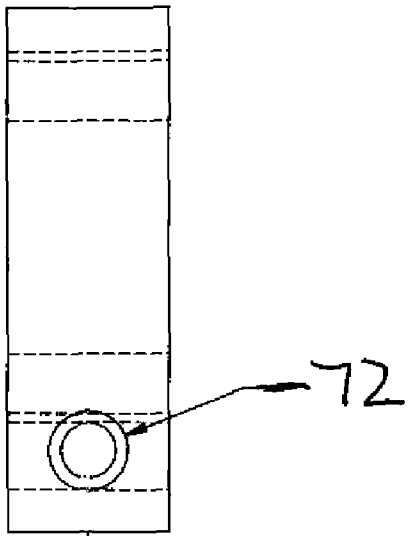
FIGS. 8A and 8B illustrate various embodiments of a brake member of the portable exercise device of FIG. 1
Figure 8A:
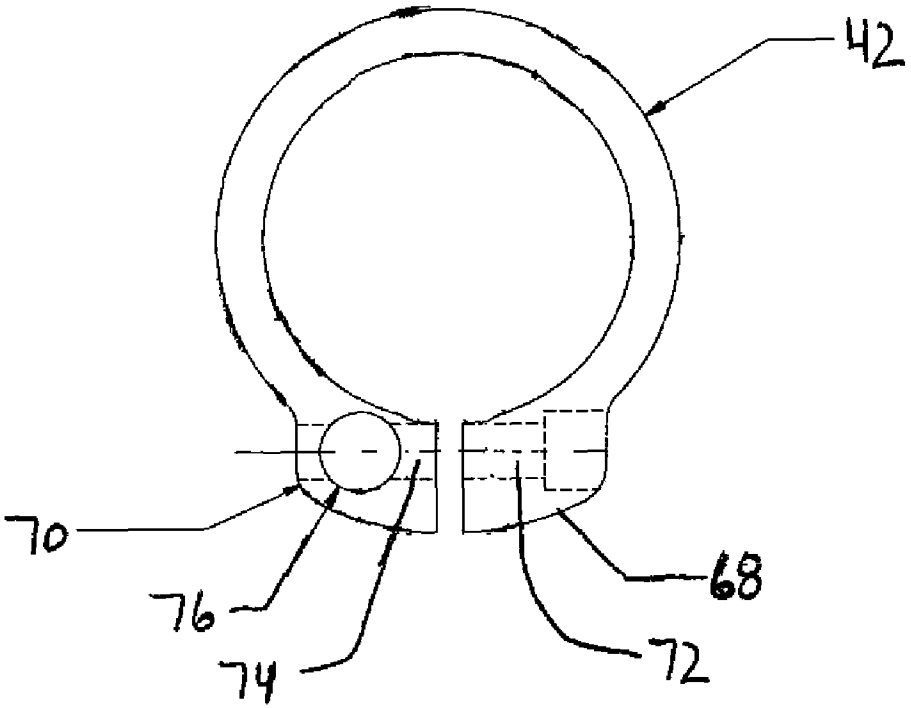

FIGS. 8A and 8B illustrate various embodiments of the brake member 42 of the portable exercise device 10 of FIG. 1. The brake member 42 may be fabricated from any suitable material. For example, according to various embodiments, the brake member 42 is fabricated from a plastic (e.g., an ultra high weight molecular polyethylene). As shown in the top view of FIG. 8A, the brake member 42 includes a first end 68 and a second end 70. The first end 68 defines an opening 72 therethrough, and the second end 70 also defines an opening 74 therethrough, wherein the openings 72, 74 are aligned with one another. The second end 70 also defines another opening 76 therethrough. The opening 76 is substantially perpendicular to and passes through the opening 74, and is configured to receive a plug member (not shown for purposes of clarity). The plug member also defines an opening (not shown) which is coaxial with the openings 72, 74. The opening defined by the plug member may be threaded and configured to receive the threaded member of the adjustment assembly 48. FIG. 8B is a side view of the brake member 42.

Figure 9A:
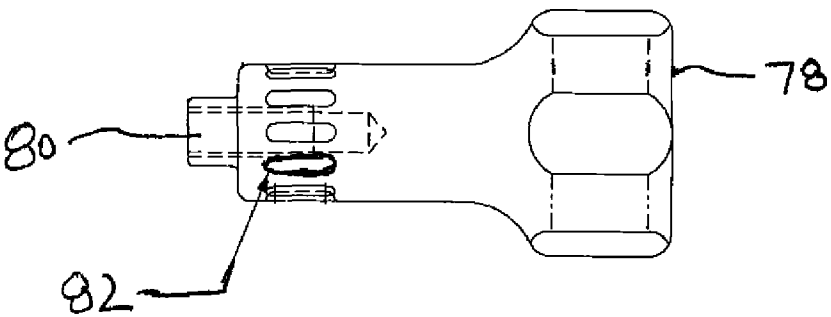
FIGS. 9A and 9B illustrate various embodiments of a knob of an adjustment assembly of the portable exercise device of FIG. 1
Figure 9B:
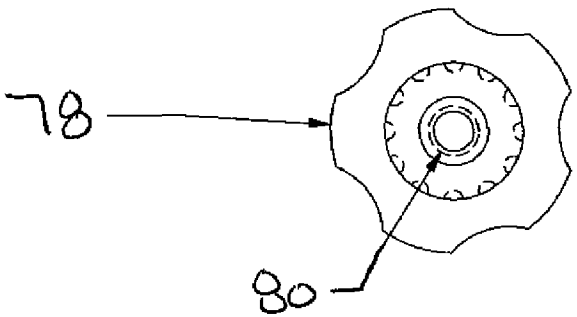

FIGS. 9A and 9B illustrate various embodiments of the knob 78 of the adjustment assembly 48 of the portable exercise device 10 of FIG. 1. The knob 78 may be fabricated from any suitable material. For example, according to various embodiments, the knob 78 is fabricated from an aluminum. According to other embodiments, the knob 78 is fabricated from a plastic. As shown in the side view of FIG. 9A, the knob 78 defines an opening 80 configured to receive the threaded member of the adjustment assembly 48, and also defines a plurality of grooves 82. When the knob 78 is rotated to tighten or loosen the coupling between the brake member 46 and the hub member 42, the grooves 82 come into contact with a detent (e.g., a pin) which extends from the second portion 24 of the housing assembly 20. The interaction between the grooves 82 and the detent produces a clicking sound and a slightly greater resistance to rotating the knob 78. The clicking sound and/or the greater resistance may provide sensory feedback to the person who is rotating the knob 78 knob. FIG. 9B is a top view of the knob 78.

Figure 10A:
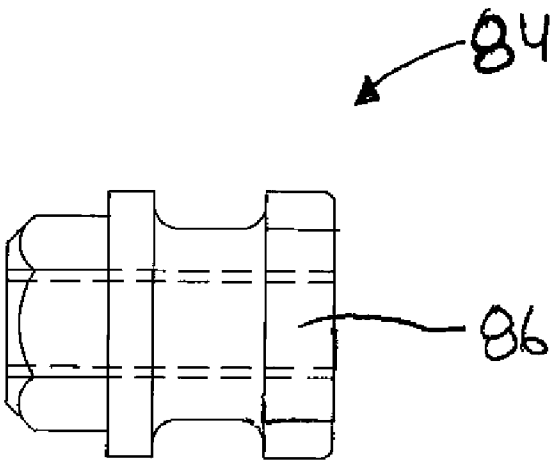
FIGS. 10A and 10B illustrate various embodiments of a fastener of the adjustment assembly of the portable exercise device of FIG. 1.
Figure 10B:
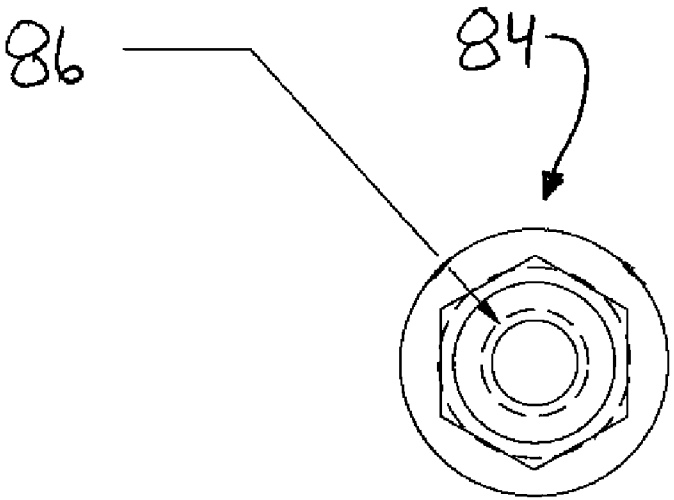

FIGS. 10A and 10B illustrate various embodiments of the fastener 84 of the adjustment assembly 48 of the portable exercise device 10 of FIG. 1. The fastener 84 may be fabricated from any suitable material. For example, according to various embodiments, the fastener 84 is fabricated from an aluminum. According to other embodiments, the fastener 84 is fabricated from a plastic. As shown in the side view of FIG. 10A, the fastener 84 defines an opening 86 therethrough configured to receive the threaded member of the adjustment assembly 48. FIG. 10B is a top view of the fastener 84.

Figure 11A:
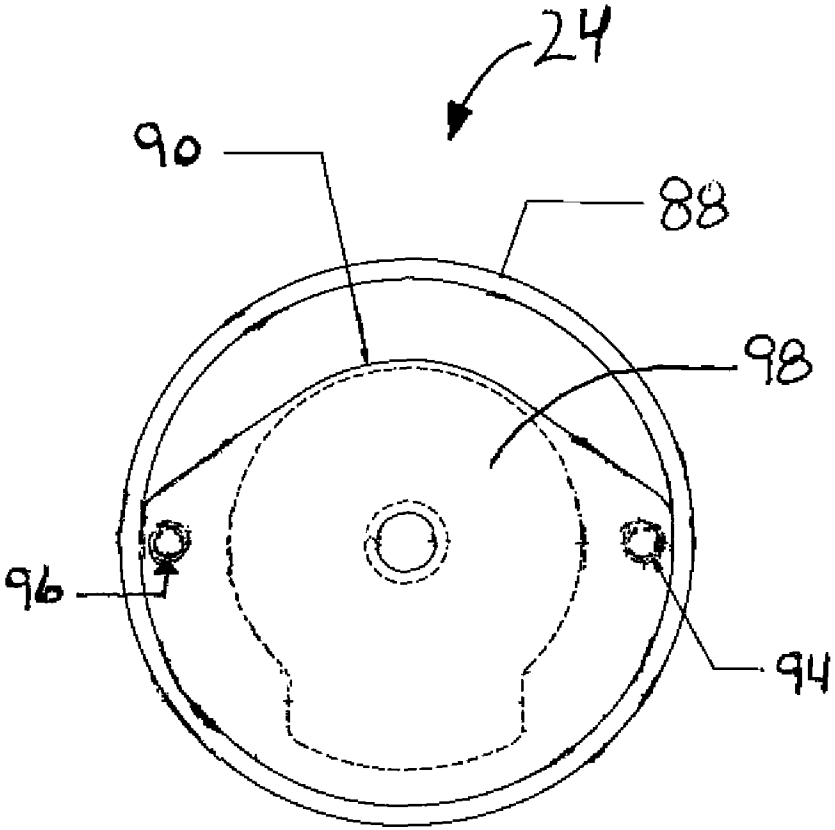
FIGS. 11A and 11B illustrate various embodiments of a second portion of the housing assembly of the portable exercise device of FIG. 1.
Figure 11B:
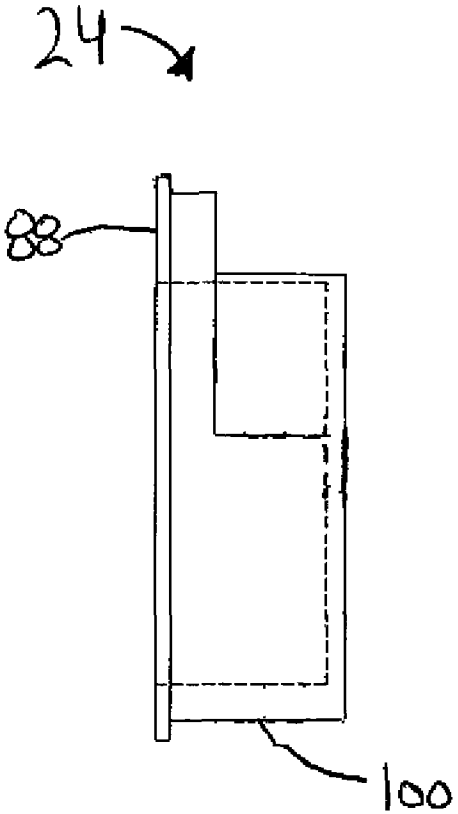

FIGS. 11A and 11B illustrate various embodiments of the second portion 24 of the housing assembly 20 of the portable exercise device 10 of FIG. 1. The second portion 24 may be fabricated from any suitable material. For example, according to various embodiments, the second portion 24 is fabricated from an aluminum. According to other embodiments, the second portion 24 is fabricated from a plastic. As shown in the top view of FIG. 11A, the second portion 24 includes a substantially circular lip 88, defines a configured projection 90, defines an opening 92 which passes through the second portion 24 and is aligned with the central axis 26, and defines two threaded openings 94, 96 which are utilized to connect the portable exercise device 10 to any of a plurality of different clamping devices. The second portion 24 also defines a volume 98 configured to receive and surround the brake member 42.

The configured projection 90 allows the portable exercise device 10 to be received by a plurality of different clamping assemblies to facilitate the use of the portable exercise device 10 in a plurality of different environments. The clamping assemblies will be described in more detail hereinbelow. Although the "topmost" surface of the second portion 24 is substantially planar, the sidewall 100 of the configured projection 90 may be embodied in any number of shapes. As shown in FIG. 11A, some lengths of the sidewall 100 are substantially straight, some lengths of the sidewall 100 are curved, and some of the curved lengths have are associated with a radius that is different than a radius associated with other of the curved lengths. It will be appreciated that the configured projection may be embodied in other combinations of shapes. FIG. 11B is a side view of the second portion 24.

Figure 12A:
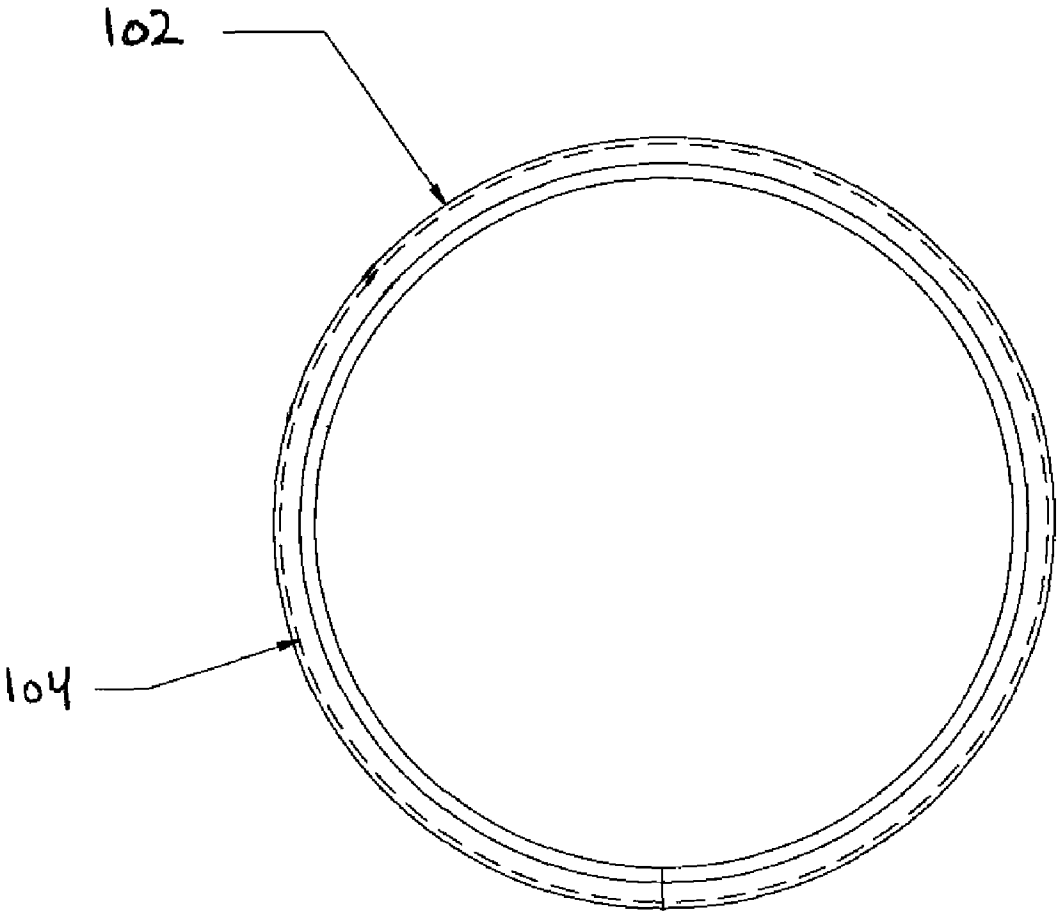
Figure 12B:
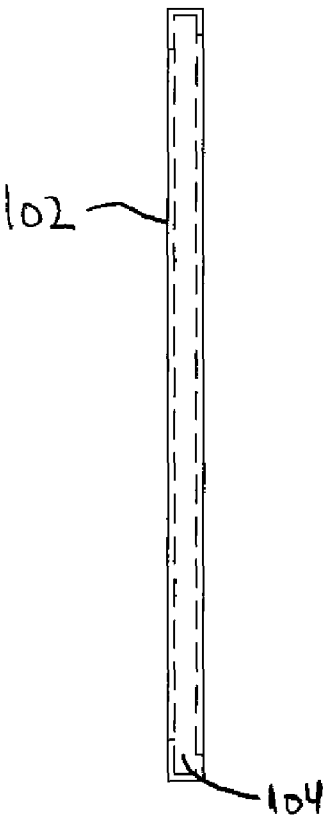

FIGS. 12A and 12B illustrate various embodiments of the sleeve 102 of the portable exercise device 10 of FIG. 1. The sleeve 102 may be fabricated from any suitable material. For example, according to various embodiments, the sleeve 102 is fabricated from a plastic (e.g., polyvinyl chloride). As shown in the top view of FIG. 12A, the sleeve 102 is open ended, and is substantially cylindrical in shape. FIG. 12B is a side view of the sleeve 102, and shows a recess 104 (the volume between the dotted lines) which is configured to receive the lip 88 of the second portion 24 of the housing assembly 20.

Figure 13B:
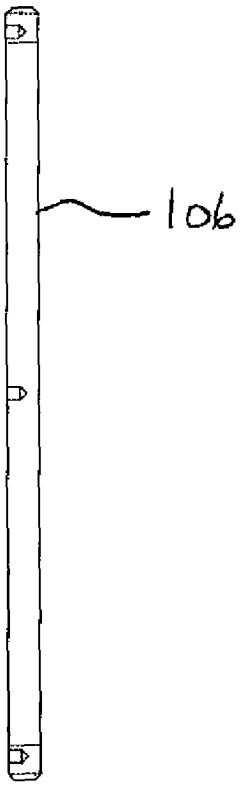
FIGS. 13A and 13B illustrate various embodiments of a retainer ring of the portable exercise device of FIG. 1.
Figure 13A:
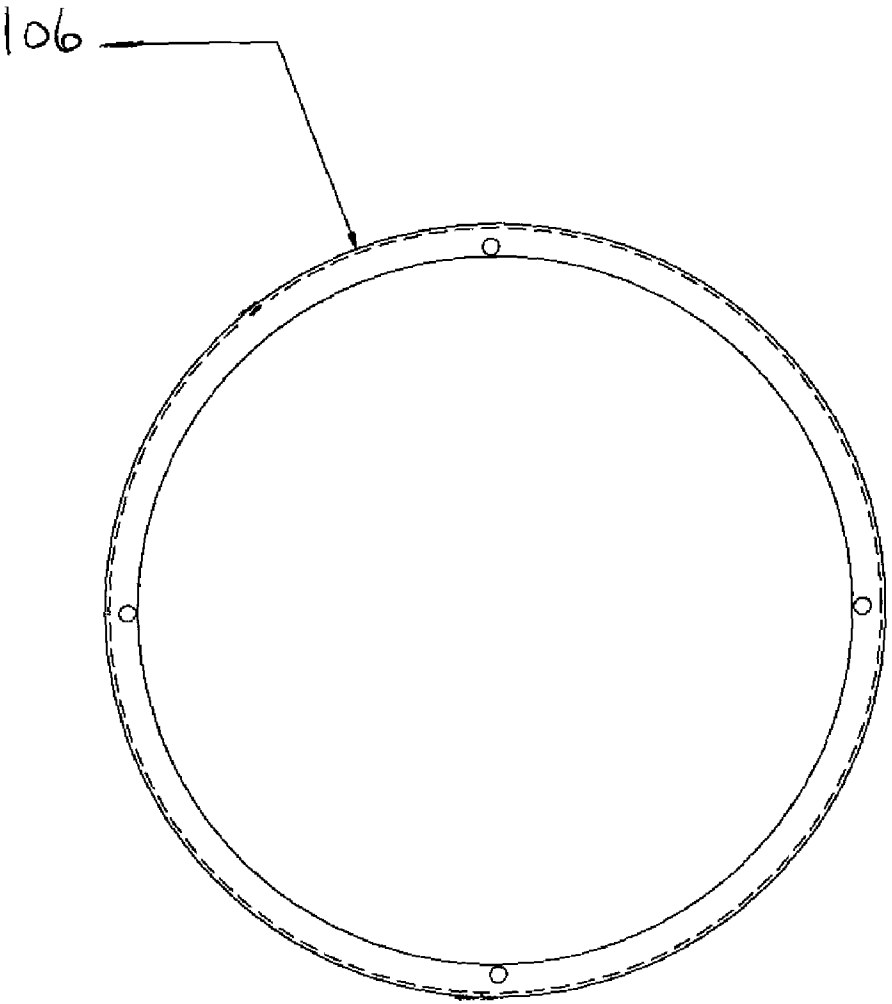

FIGS. 13A and 13B illustrate various embodiments of the retainer ring 106 of the portable exercise device 10 of FIG. 1. The retainer ring 106 may be fabricated from any suitable material. For example, according to various embodiments, the retainer ring 106 is fabricated from a steel. As shown in the top view of FIG. 13A, the retainer ring 106 is substantially cylindrical in shape. As described hereinabove, the retainer ring 106 is coupled to the sleeve 102, and is threadedly connected to the first portion 22 of the housing assembly 20. FIG. 12B is a side view of the retainer ring 106.

Figure 14A:
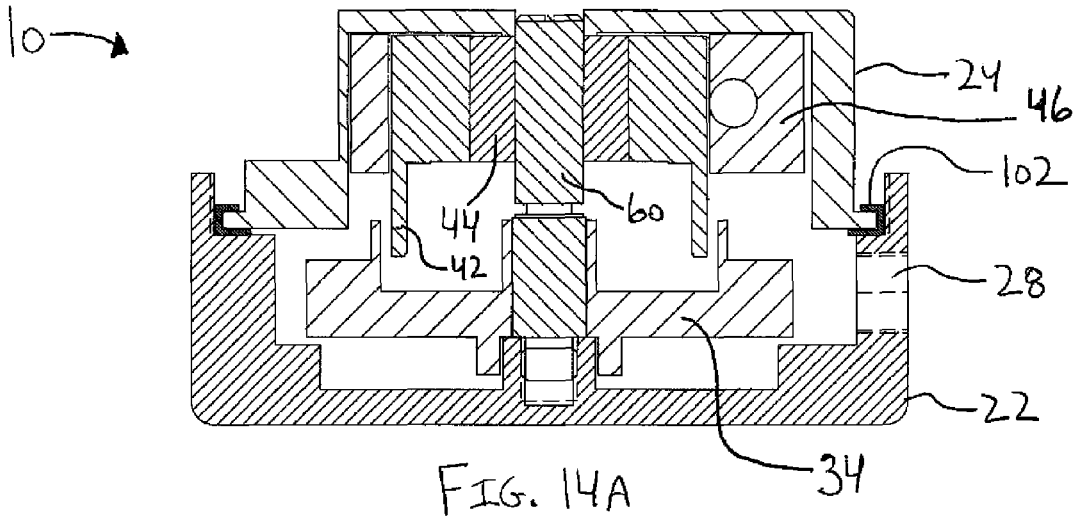
FIGS. 14A and 14B illustrate various embodiments of the portable exercise device 10 of FIG. 1.
Figure 14B:
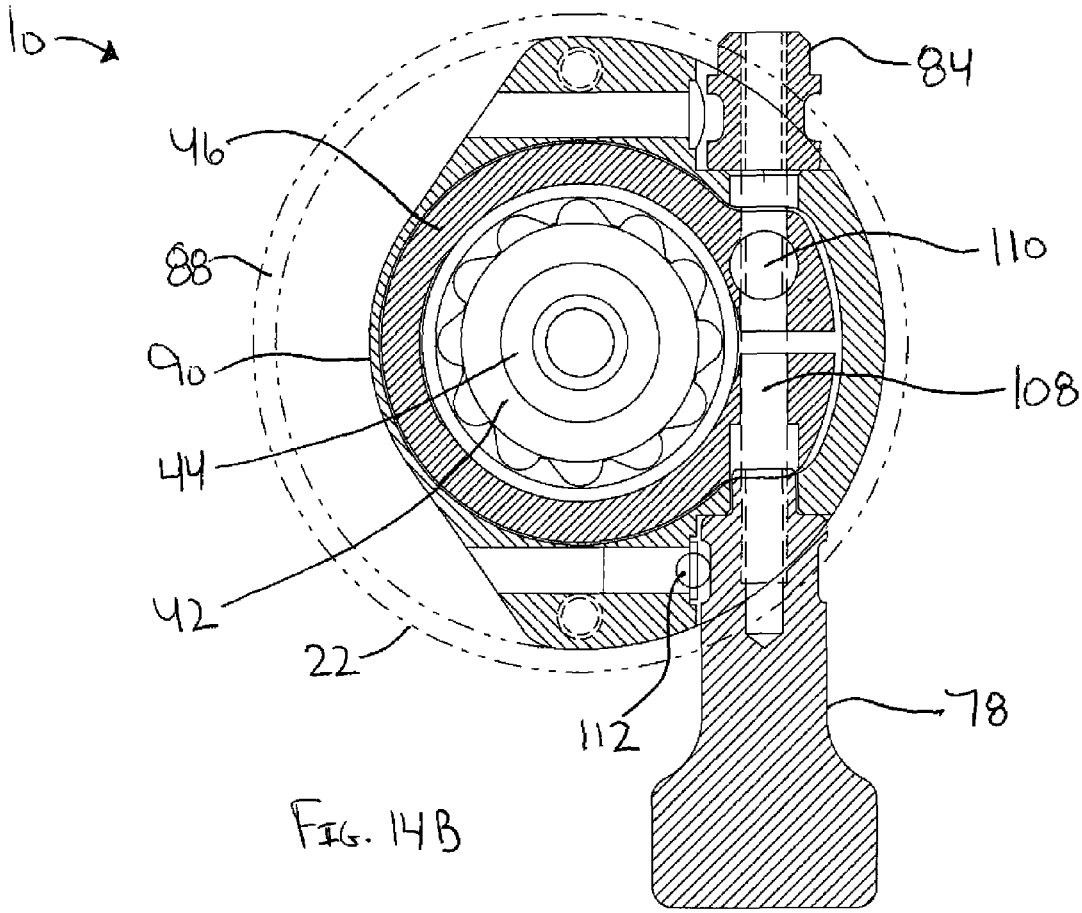

FIGS. 14A and 14B illustrate various embodiments of the portable exercise device 10 of FIG. 1. For purposes of clarity, not all of the components are shown in FIGS. 14A and 14B. FIG. 14A is a side view of the portable exercise device 10 and shows how the second portion 24 of the housing assembly 20 is received by and surrounded by the first portion 22 of the housing assembly 20. Although not shown in FIG. 14A, it will be appreciated that the retainer ring 106 is positioned directly "over" the "top" surface of the sleeve 102 after the retainer ring 106 is threadedly connected to the first portion 22 of the housing assembly 20.

FIG. 14B is a top view of the portable exercise device 10, and shows the threaded member 108 of the adjustment assembly 48, the plug member 110 positioned in the opening 76 defined by the brake member 42, and the detent 112 which extends from the second portion 24 of the housing assembly 20.

Figure 15:
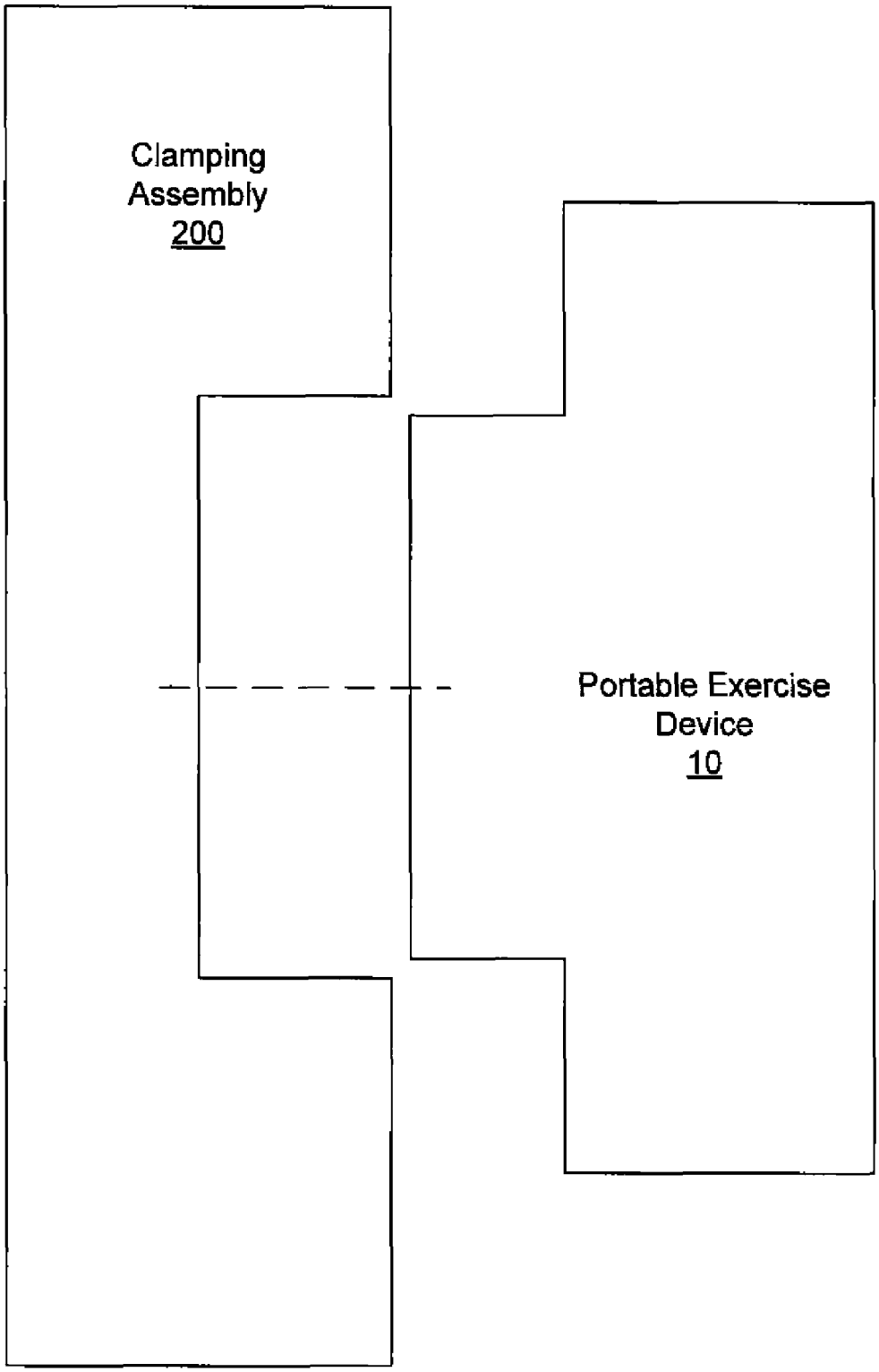
FIG. 15 illustrates a high level representation of a system according to various embodiments.

FIG. 15 illustrates a high level representation of a system 200 according to various embodiments. For purposes of clarity, the high-level representation is shown in an exploded view. The system 200 includes the portable exercise device 10, and a clamping assembly 202 removably connected to the portable exercise device 10. The clamping assembly 202 may be any suitable type of clamping assembly. In general, the clamping assembly 202 defines a recess configured to receive the configured projection 90 of the portable exercise device 10, defines two openings aligned with the two threaded openings 94, 96 of the second portion 24 when the configured projection 90 is received by the recess, and includes at least one adjustment member for removing connecting the clamping assembly 202 to a table, a bench, a wheel chair, a pole, etc. Various embodiments of the clamping assembly 202 are described in more detail hereinbelow.

Figure 16B:
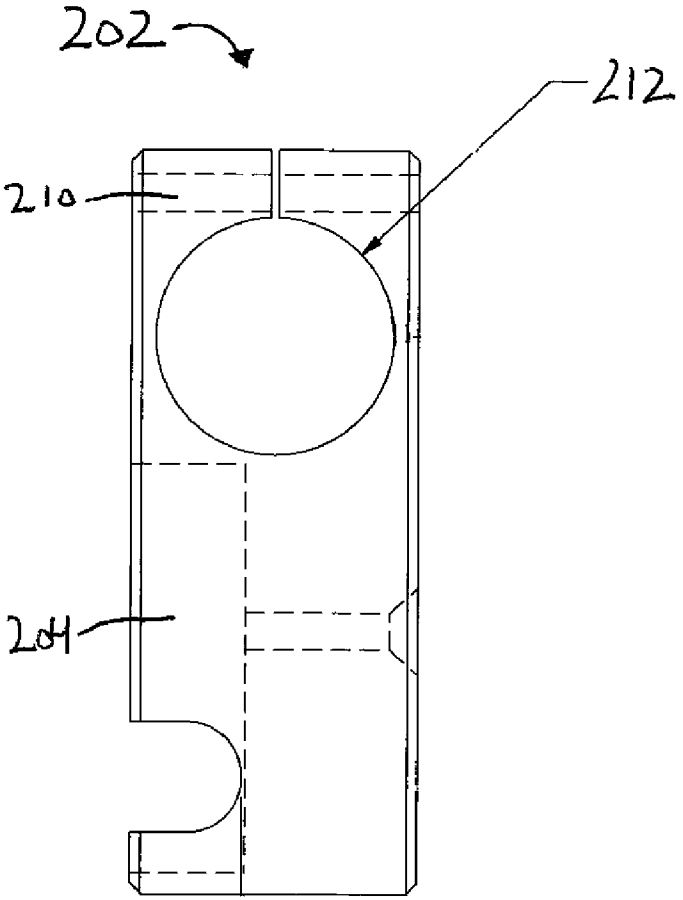
FIGS. 16A and 16B illustrate various embodiments of a clamping assembly of the system of FIG. 15.
Figure 16A:
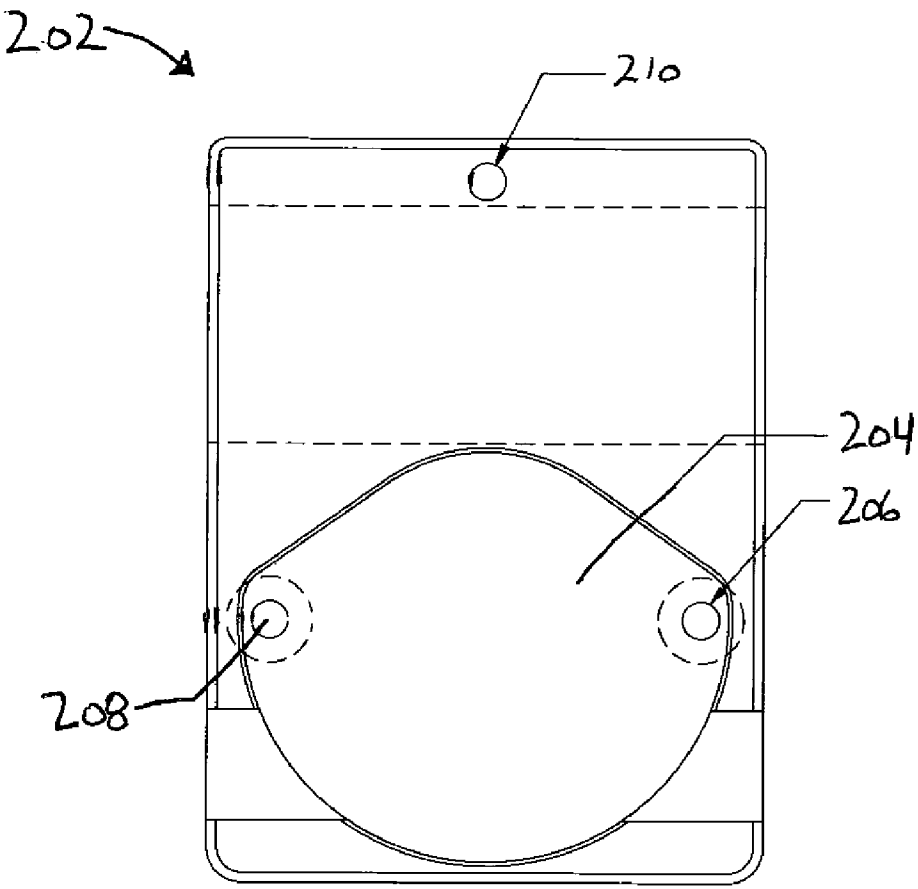

FIGS. 16A and 16B illustrate various embodiments of the clamping assembly 202. For these embodiments, as shown in the front view of FIG. 16A, the clamping assembly 202 defines a recess 204 configured for receiving the configured projection 90 of the portable exercise device 10, defines two openings 206, 208 respectively aligned with the two threaded openings 94, 96 of the second portion 24 when the configured projection 90 is received by the recess 204, and defines an opening 210 therethrough which is configured to receive an adjustment member. As shown in the side view of FIG. 1613, the clamping assembly 202 defines an opening 212 therethrough for receiving a pole or other structure, and is open-ended as shown above the opening 212. Although not shown for purposes of clarity, the clamping assembly 202 also includes an adjustment assembly. The adjustment assembly may be embodied by a threaded member and a knob. After a pole or other member is received by the opening 212, the knob may be rotated in one direction to cause the opening 212 to become smaller slightly, thereby securing the clamping assembly 202 to the pole or other member, or in the opposite direction to cause the opening 212 to become slightly larger so that the pole or other member can be removed from the opening 212, thereby removing the clamping assembly 202 from the pole or other member.

Figure 17B:
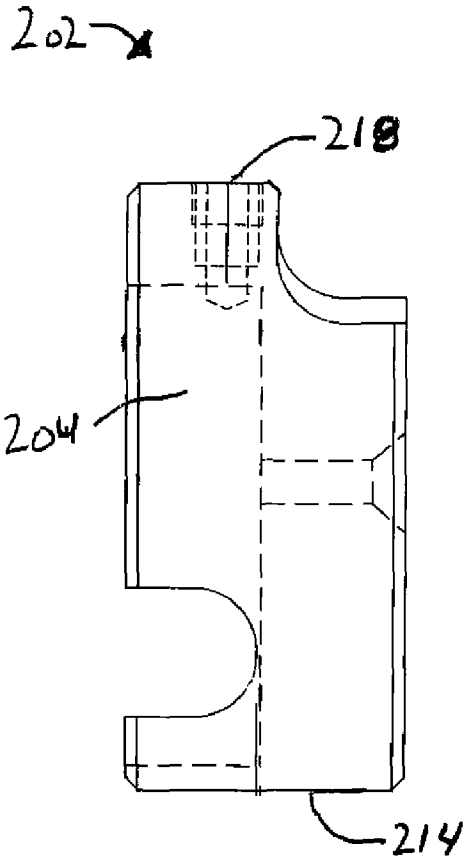
FIGS. 17A-17E illustrate other embodiments of a clamping assembly of the system of FIG. 15.
Figure 17A:
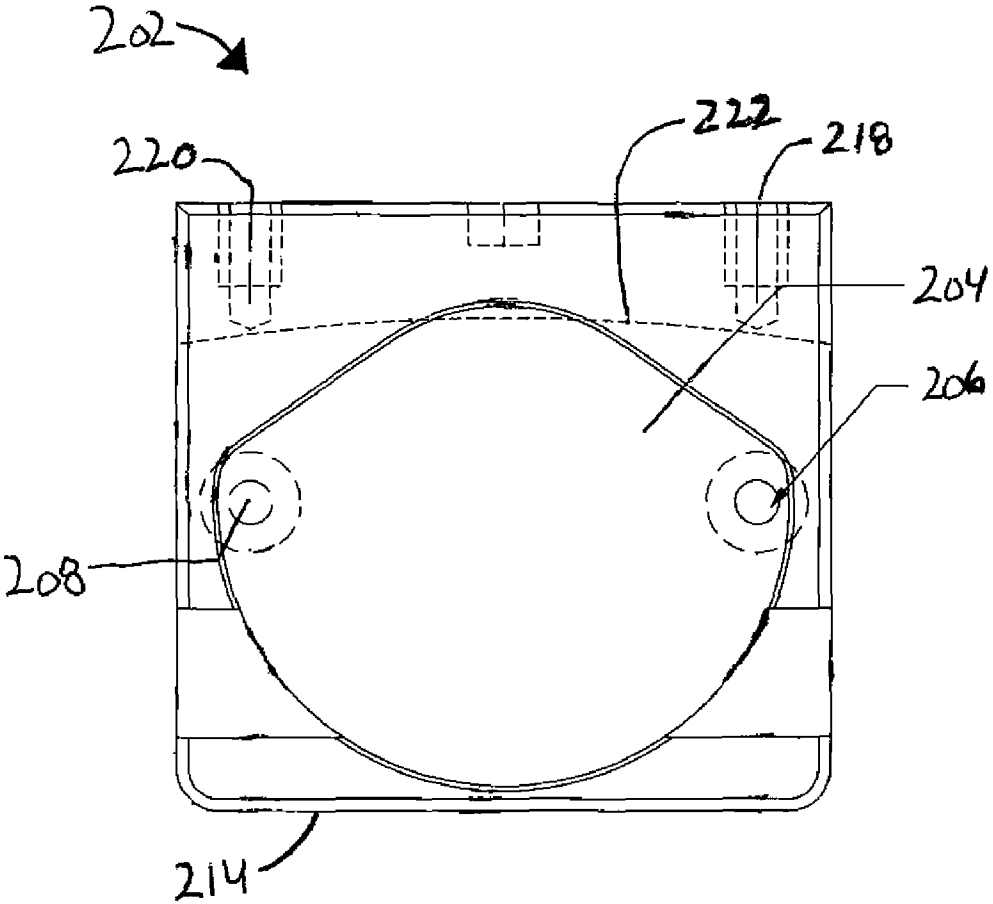

FIGS. 17A-17E illustrate other embodiments of the clamping assembly 202. For these embodiments, the clamping assembly 202 includes a body 214 (see FIGS. 17A and 17B) and an adjustment assembly 216 (see FIGS. 17C-17E) removably coupled to the body 214. As shown in the front view of FIG. 17A, the body 214 defines a recess 204 configured for receiving the configured projection 90 of the portable exercise device 10, defines two openings 206, 208 respectively aligned with the two threaded openings 94, 96 of the second portion 24 when the configured projection 90 is received by the recess 204, defines two other openings 218, 220 configured to receive the adjustment assembly 216, and defines a fixed jaw 222. The fixed jaw 222 may be of any suitable shape, and according to various embodiments, includes a curved surface. FIG. 17B is a side view of the body 214.

Figure 17D:
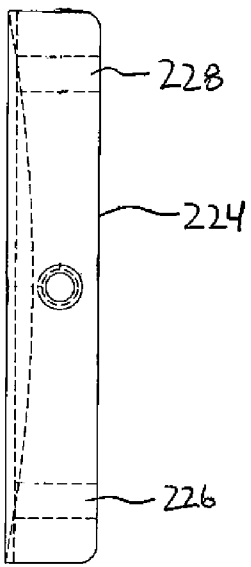
Figure 17C:
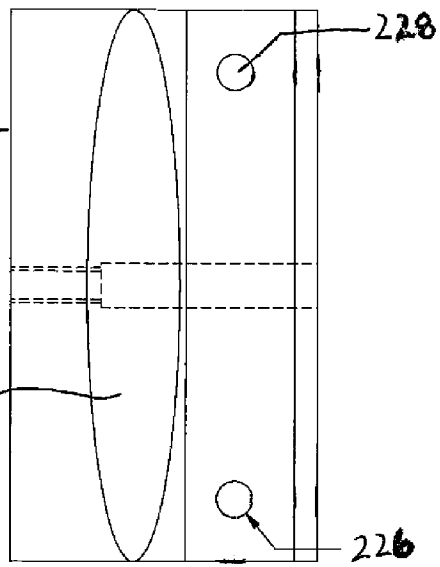
Figure 17E:
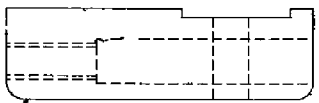

As shown in the bottom view of 17C, the adjustment assembly 216 includes a movable jaw 224 which defines two openings 226, 228 which are respectively aligned with the openings 214, 216 when the adjustment assembly 216 is coupled to the body 214. The movable jaw 224 may be of any suitable shape, and according to various embodiments, defines a recess 230 which cooperates with the fixed jaw 222 to secure the clamping assembly 202 to a fixture such as, for example, a wheel of a wheelchair. FIG. 17D is a front view of the adjustment assembly 216, and FIG. 17E is a side view of the adjustment assembly 216. Although not shown for purposes of clarity, the adjustment assembly 216 also includes two threaded members and two knobs. The knobs may be rotated in one direction to cause the movable jaw 224 to advance toward the fixed jaw 222 until the fixture is secured to the clamping assembly 202, or in the opposite direction to cause the movable jaw 222 to advance away from the fixed jaw 222 so that the clamping assembly 202 can be removed from the fixture.

FIGS. 18A-18F illustrate yet other embodiments of the clamping assembly 202. For these embodiments, the clamping assembly 202 includes a body 232 (see FIGS. 18A-18C) and an adjustment assembly 234 (see FIGS. 18D-18F) removably coupled to the body 232. As shown in the front view of FIG. 18A, the body 232 defines a recess 204 configured for receiving the configured projection 90 of the portable exercise device 10, and defines two openings 206, 208 respectively aligned with the two threaded openings 94, 96 of the second portion 24 when the configured projection 90 is received by the recess 204. As shown in the side view of FIG. 18B, the body 232 defines a fixed jaw 236. The fixed jaw 236 may be of any suitable shape, and according to various embodiments, defines a recess 238. As shown in the rear view of FIG. 18C, the body 232 also defines a recess 240 configured for receiving the adjustment assembly 234.

Figure 18C:
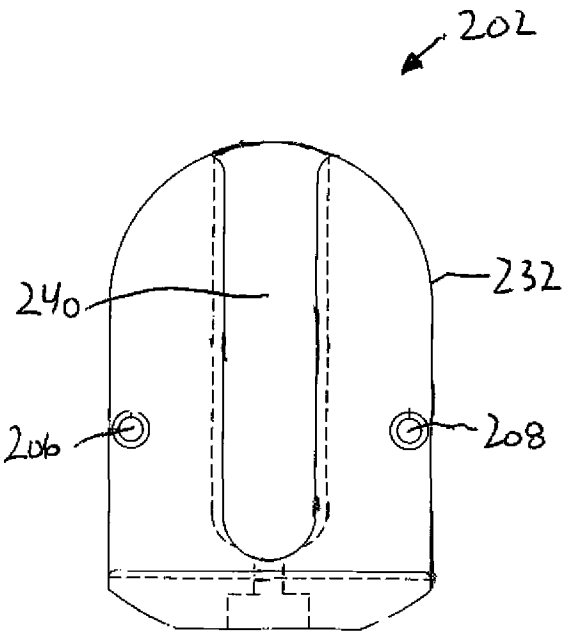
FIGS. 18A-18F illustrate yet other embodiments of a clamping assembly of the system of FIG. 15.
Figure 18B:
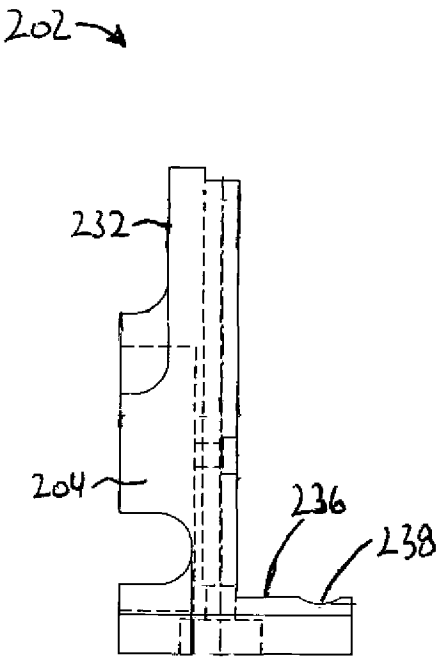
Figure 18A:
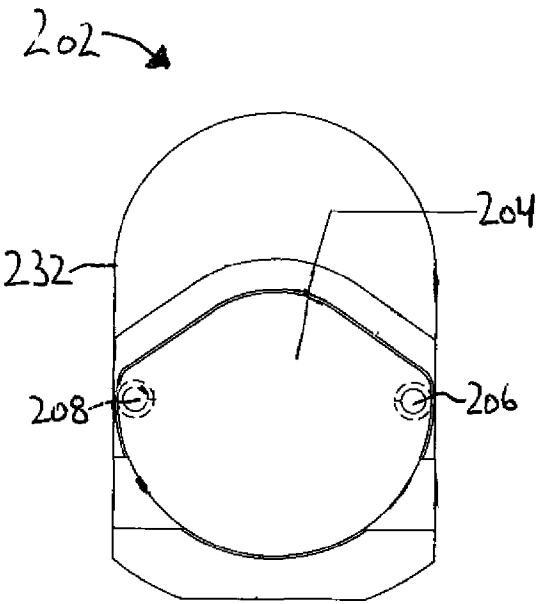
Figure 18E:
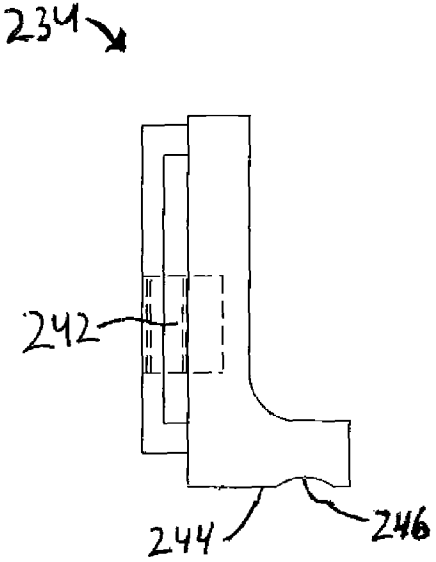
Figure 18D:
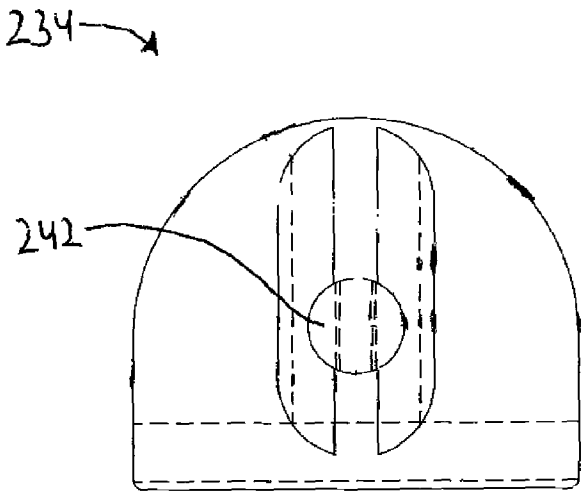
Figure 18F:
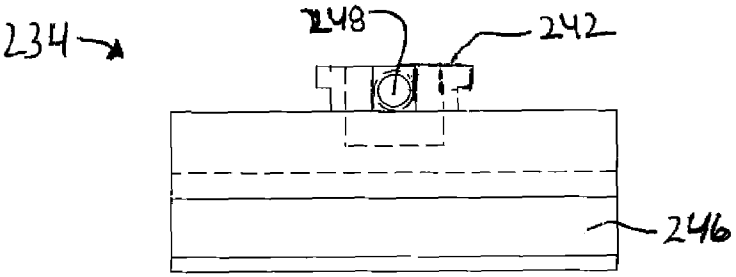

FIG. 18D illustrates a face of the adjustment assembly 234 which abuts a face of the body 232. The adjustment assembly 234 includes a guide member 242 which is configured to travel along the recess 240 both toward and away from the fixed jaw 236. As shown in the side view of FIG. 18E, the adjustment assembly 234 defines a movable jaw 244. The movable jaw 244 may be of any suitable shape, and according to various embodiments, defines a recess 246 which cooperates with the fixed jaw 236 to secure the clamping assembly 202 to any of a number of different fixtures. As shown in the bottom view of FIG. 18F, the guide member 242 defines an opening 248 therethrough which is configured to receive a threaded member. Although not shown in FIGS. 18D-18F for purposes of clarity, the adjustment assembly 234 also includes a threaded member, and a knob connected to the threaded member. The knob may be rotated in one direction to cause the movable jaw 244 to advance toward the fixed jaw 2236 until the fixture is secured to the clamping assembly 202, or in the opposite direction to cause the movable jaw 244 to advance away from the fixed jaw 236 so that the clamping assembly 202 can be removed from the fixture.

Nothing in the above description is meant to limit the invention to any specific materials, geometry, or orientation of elements. Many part/orientation substitutions are contemplated within the scope of the invention and will be apparent to those skilled in the art. The embodiments described herein were presented by way of example only and should not be used to limit the scope of the invention.

Although the invention has been described in terms of particular embodiments in this application, one of ordinary skill in the art, in light of the teachings herein, can generate additional embodiments and modifications without departing from the spirit of, or exceeding the scope of, the claimed invention. Accordingly, it is understood that the drawings and the descriptions herein are proffered only to facilitate comprehension of the invention and should not be construed to limit the scope thereof.

What is claimed is:

1. A portable exercise device, comprising:
- a recoil assembly;
- a clutch assembly coupled to the recoil assembly;
- an adjustable resistance assembly coupled to the clutch assembly;
- a housing assembly, wherein the housing assembly comprises:
  - a first portion which:
    - defines an opening through the first portion; and
    - surrounds the recoil assembly and the clutch assembly; and
  - a second portion rotatably coupled to the first portion, wherein the second portion:
    - defines a configured projection which comprises:
      - a sidewall; and
      - a top connected to the sidewall; and
    - surrounds the adjustable resistance assembly;
- a flexible cable member coupled to the recoil assembly, wherein the flexible cable member extends through the opening defined by the first portion of the housing assembly; and
- a user engagement member coupled to the flexible cable member.

2. The portable exercise device of claim 1, wherein the recoil assembly comprises:
- a spiral spring member surrounded by the first portion of the housing assembly; and
- a rotor member coupled to the flexible cable member and the spiral spring member, wherein the rotor member is surrounded by the first portion of the housing assembly.

3. The portable exercise device of claim 2, wherein the rotor member is rotatable about a central axis of the housing assembly.

4. The portable exercise device of claim 2, wherein the recoil assembly further comprises a spiral spring cover member, wherein the spiral spring cover member surrounds the spiral spring member and is surrounded by the first portion of the housing assembly.

5. The portable exercise device of claim 1, wherein the clutch assembly comprises:
- a plurality of dog pawls pivotably coupled to the recoil assembly; and
- a hub member coupled to the dog pawls, wherein the hub member defines a plurality of directional teeth and is surrounded by the first portion of the housing assembly.

6. The portable exercise device of claim 5, wherein the hub member is rotatable about a central axis of the housing assembly.

7. The portable exercise device of claim 5, wherein the clutch assembly further comprises a bushing surrounded by the hub member.

8. The portable exercise device of claim 7, wherein the bushing is rotatable about a central axis of the housing assembly.

9. The portable exercise device of claim 1, wherein the adjustable resistance assembly comprises:
- a brake member which surrounds the clutch assembly, wherein the brake member is open ended and is surrounded by the second portion of the housing assembly; and an adjustment assembly configured to couple the brake member to the clutch assembly, wherein the adjustment assembly passes through two openings defined by the brake member and two openings defined by the second portion of the housing assembly.

10. The portable exercise device of claim 9, wherein at least one of the two openings defined by the brake member is a threaded opening, and wherein the adjustment assembly is threadedly connected to the brake member.

11. The portable exercise device of claim 9, wherein the adjustment assembly comprises:

a threaded member which passes through the two openings defined by the brake member and the two openings defined by the second portion of the housing assembly;

a knob connected to the threaded member and positioned external to the housing assembly; and a fastener connected to the threaded member and positioned external to the housing assembly.

12. The portable exercise device of claim 9, wherein the adjustable resistance assembly further comprises a plug member positioned within a third opening defined by the brake member, and wherein the plug member is threadedly connected to the adjustment assembly.

13. The portable exercise device of claim 1, further comprising a shaft member extending from a surface of the first portion of the housing assembly to a surface of the second portion of the housing assembly, wherein the shaft member is surrounded by the recoil assembly, the clutch assembly, and the adjustable resistance assembly.

14. The portable exercise device of claim 13, wherein an end of the shaft member is positioned within a receptacle defined by the first portion of the housing assembly.

15. The portable exercise device of claim 1, further comprising a sleeve connected to the second portion of the housing assembly.

16. The portable exercise device of claim 15, further comprising a retainer ring coupled to the sleeve and threadedly connected to the first portion of the housing assembly.

17. The portable exercise device of claim 1, wherein the user engagement member comprises a handle, wherein the handle is positioned external to the housing assembly.

18. A system, comprising:

a portable exercise device, wherein the portable exercise device comprises:

a recoil assembly;

a clutch assembly coupled to the recoil assembly;

an adjustable resistance assembly coupled to the clutch assembly;

a housing assembly, wherein the housing assembly comprises:

a first portion which:

defines an opening through the first portion; and surrounds the recoil assembly and the clutch assembly; and a second portion rotatably coupled to the first portion, wherein the second portion:

defines a configured projection which comprises:

a sidewall; and a top connected to the sidewall:, and surrounds the adjustable resistance assembly; and a flexible cable member coupled to the recoil assembly, wherein the flexible cable member extends through the opening defined by the first portion of the housing assembly; and a clamping assembly removably connected to the portable exercise device, wherein the clamping assembly defines a recess configured to receive the configured projection of the second portion of the housing assembly of the portable exercise device.

19. The system of claim 18, wherein the clamping assembly comprises a fixed jaw and a movable jaw.

20. The system of claim 18, wherein the clamping assembly is open-ended.

* * * * *